United States Patent [19]

Noé et al.

[11] Patent Number: 4,842,178

[45] Date of Patent: Jun. 27, 1989

[54] BAND STORAGE SYSTEM FOR MOVING BANDS

[75] Inventors: Oskar Noé; Rolf Noé; Andreas Noé, all of Mülheim, Fed. Rep. of Germany

[73] Assignee: Blug Bergwerk und Walzwerk GmbH, Fed. Rep. of Germany

[21] Appl. No.: 47,898

[22] Filed: May 7, 1987

[30] Foreign Application Priority Data

Oct. 28, 1986 [DE] Fed. Rep. of Germany ..... 3636652

[51] Int. Cl.[4] ..... B65H 25/20

[52] U.S. Cl. ..... 226/113; 226/119

[58] Field of Search ..... 226/113, 118, 119

[56] References Cited

U.S. PATENT DOCUMENTS

| | | | |
|---|---|---|---|
| 3,414,179 | 12/1968 | Huck | 226/113 |
| 3,515,327 | 6/1970 | Bortmas | 226/118 X |
| 3,700,157 | 10/1972 | Shumaker | 226/118 X |
| 4,009,814 | 3/1977 | Singh | 226/113 |
| 4,360,137 | 11/1982 | Noé et al. | 226/119 X |
| 4,462,226 | 7/1984 | Fleissner | 226/119 X |
| 4,474,321 | 10/1984 | Komoto et al. | 226/113 |

*Primary Examiner*—Stuart S. Levy
*Assistant Examiner*—Katherine Matecki
*Attorney, Agent, or Firm*—McGlew & Tuttle

[57] ABSTRACT

A band store includes a plurality of horizontally movable loop carts, of which one loop cart drive is traction controlled and the other loop cart drives are speed controlled, and this control is effected as a function of the speed of the traction controlled loop cart drive. Thereby synchronous running of the loop carts is achieved.

2 Claims, 1 Drawing Sheet

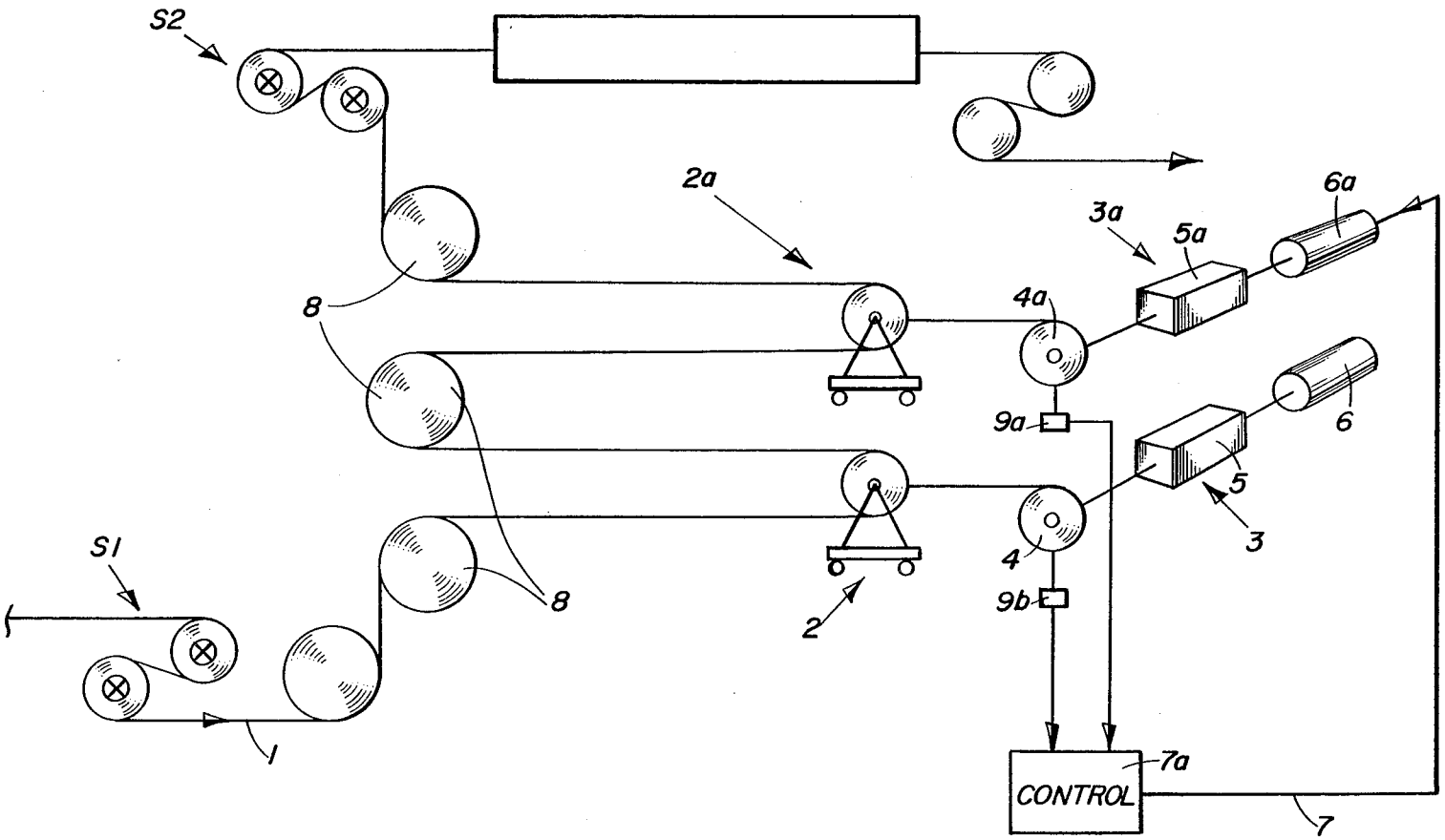
6a
6
5a
5
3a
3
7
7a
CONTROL
4a
9a
4
9b
2a
2
8
8
S2
S1
1

BAND STORAGE SYSTEM FOR MOVING BANDS

FIELD AND BACKGROUND OF THE INVENTION

The invention relates in general to metal treating systems and in particular to a new and useful band store or storage system for bands/belts running through guide passages continuously, in particular metal bands, in treatment systems, with at least two movable loop carts or guide or guide reel carriages and loop cart drives.

In the inlet and outlet of band treatment systems for e.g. paper bands, plastic bands, metal bands or the like, with continuous operation in a process section, it is necessary to provide a band storage area which bridges the down times when changing ties or bundles. In the treatment of metal bands, the process section may be e.g. a stretching installation, a pickling installation, a galvanizing installation and a paint coating installation etc. It is known to provide band stores which extend horizontally and comprise one or more loop carts or so-called loop cart band stores. The loop carts are movable horizontally and usually arranged one above the other. The speed of the loop carts is determined by upstream or downstream connected tension roller sets, and the loop carts are run traction or force controlled via winches. In high speed treatment installations, e.g. pickling installations, the available installation length is normally not sufficient for running with one loop cart only. For this reason, two or more loop carts are arranged one above the other, in particular at the infeed and, due to the welding together of metal bands to be joined, relatively long down times must be bridged. Since in the known forms of construction all loop cart drives are traction controlled, that is according to the force (tensions) or load experienced by the loop cart as a result of band tension, the desired synchronization of the loop carts does not exist because the loop carts are under different loads. In the extreme case, one loop cart alone can run at double the speed, and only after this loop cart is in the end position will the next loop cart run to its end position at double the speed also. Owing to this, retractable band supporting rollers normally installed in the band store are retracted so fast that damage will occur. The attempt has been made to remedy this deficiency by reducing the winch cable tension of the respective preceding loop cart. But since, e.g. in a pickling installation, very different band dimensions and band strengths are run successively, asynchronous running of the loop carts again results as the joints, or weld seams, of such different metal bands are being passed.

Lastly, the procedure has been adopted to couple the loop cart drives, or their winches, by means of a connecting shaft, to ensure synchronism. This solution, a costly one is not satisfactory either, since due to unequal conditions or loads of the loop cars their transmissions are also differently stressed. In particular in case of blocking of a loop cart damage to the transmission must be feared, because then the power of the loop cart drives or cable winch drives must be absorbed by a single loop cart drive or winch drive.

SUMMARY OF THE INVENTION

The invention provides a band store for bands or belts running through continuously, in particular metal bands, in treatment installations, wherein synchronous running of all loop carts in a functionally proper and simple manner is ensured.

The invention includes a band store or storage with one traction controlled loop cart drive and other loop cart drives which are speed controlled as a function of the speed of the traction controlled loop cart drive. With the invention the other loop cart drive can be controlled as a function of the path or distance travelled by the traction controlled loop cart. According to the teaching of the invention, therefore, the other, not traction controlled loop cart drives are coupled in a speed or path dependent manner to the speed or path of the traction controlled loop cart drive or cable winch drive. The surprising effect then occurs that the speed or path controlled loop cart drive experiences exactly only that traction which is predetermined by the traction controlled loop cart drive. Only in different bands or metal bands with semi-plastic bending does the traction at the speed-or path-dependently controlled loop cart drives increase in accordance with the bending losses. The combination of a traction controlled loop cart drive and a loop cart or cable winch drive which is speed controlled as a function of the speed of the traction controlled loop cart ensures synchronous running of all loop carts within smallest tolerances. Besides, the loop cart drives may be equipped with an overload safety device which, in case of a blockage, provides for emergency stoppage of the loop cart drives.

Accordingly it is an object of the invention to provide a band storage system which comprises means for guiding a band through a plurality of horizontally extending loop paths, a movable loop cart arranged in each horizontal loop path and having a rotatable reel around which said band is looped, a traction control drive connected to one of said loop carts, a speed control drive connected to at least one of the other of said loop carts, and control means connected to said traction control drive and to said feed control drive for controlling the speed and traction to effect synchronous running of said loop carts.

The synchronous running of the loop carts is provided when synchronous motion of all loop carts is achieved. Therefore, all loop carts travel the same path or distance in the same time. It is not necessary for the loop carts to be aligned above one another to achieve such synchronous running.

A further object of the invention is to provide a band storage system which has a plurality of loop paths and includes a traction control drive and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

The only FIGURE of the drawing is a schematic representation of the band storage with horizontally moving loop carts constructed in accordance with the invention.

DESCRIPTION OF THE PREFERRED EMBODIMENTS

Referring to the drawing, in particular the invention embodied therein comprises a band storage system which has means for guiding band through a plurality of horizontally extending loop paths, each of which has a movable loop cart 2, 2*a*, etc. which have rotatable reels around which the band is looped. A traction control drive generally designated 3 is connected to at least one of the loop carts namely the loop cart 2 and a speed control drive 3*a* is connected to at least one or the other of the loop carts. Control means in the form of a control 7*a* is connected to the traction control drive and to the feed control drive for control of the speed and the traction to effect synchronous running of said loop carts.

The band store or storage system shown is for band running through continuously, in particular metal bands or belts 1, in band treatment systems. The storage system is equipped with at least two loop carts or movable reel carriages 2, 2*a* and loop cart drives 3 and 3*a*. The loop carts 2 and 2*a* are movable horizontally and in paths disposed one over the other and one loop cart drive 3 is traction controlled. The speed of the two loop carts 2, 2*a* is per se determined by the upstream or downstream connected tension roller sets S1, S2. The loop cart drives 3 and 3*a* comprise a cable winch 4, 4*a*, a transmission 5, 5*a* and a motor 6, 6*a*, e.g. electric motor. As can be seen from the single figure, the upper loop cart 2*a* must, because of the bending losses occurring in the metal band 1, hold or provide a higher pull-back load than the lower loop cart 2. The lower loop cart drive 3 is traction controlled. The upper loop cart drive 3*a* is speed controlled as a function of the speed of the lower traction controlled loop cart drive 3. The control circuit 7 is indicated schematically and includes a control 7*a* connected to respective cable winches 4 and 4*a* and the motor 6*a* for its speed control. Also sensors 9*a* and 9b are arranged to supply the control 7*a* with information concerning the traction and speed of the winches 4 and 4*a*. By the combination of traction controlled and speed controlled loop cart drives 3, 3*a* or cable winch drives, synchronous running of the two loop carts 2,2*a* is ensured. Consequently, no damage to the retractable band supporting roller 8, which are at fixed locations indicated, need be feared.

While specific embodiments of the invention have been shown and described in detail to illustrate the application of the principles of the invention, it will be understood that the invention may be embodied otherwise without departing from such principles.

What is claimed is:

1. A band storage system comprising means for guiding a band through a plurality of horizontally extending loop paths, a plurality of movable loop carts, each of said loop carts being arranged in one of said horizontal loop paths and having a rotatable reel around which said band is looped, a traction control drive connected to a first of said loop carts, a speed control drive connected to a second of said loop carts, and control means connected to said traction control drive and to said speed control drive for controlling the speed and traction of said loop carts and for effecting synchronous running of said loop carts, said control means including means for detecting the speed of the traction-controlled drive and means for controlling the speed of the speed controlled drive in response to the detected speed of the traction-controlled drive.

2. A band storage system according to claim 1, wherein said speed control drive and said traction control drive each includes a cable winch connected by a cable to an associated loop cart for moving said loop cart in a horizontal direction, and a drive motor connected to each of said cable winches.

* * * * *

UNITED STATES PATENT AND TRADEMARK OFFICE

CERTIFICATE OF CORRECTION

PATENT NO. : 4,842,178

DATED : June 27, 1989

INVENTOR(S) : Noe et al

It is certified that error appears in the above-identified patent and that said Letters Patent is hereby corrected as shown below:

Title page:

Please change the assignee from:

Blug Bergwerk und Walzwerk GmbH to:

BWG Bergwerk und Walzwerk GmbH

Signed and Sealed this

Twenty-seventh Day of November, 1990

*Attest:*

HARRY F. MANBECK, JR.

*Attesting Officer*

*Commissioner of Patents and Trademarks*